US010864514B2

(12) United States Patent
Oguma et al.

(10) Patent No.: US 10,864,514 B2
(45) Date of Patent: Dec. 15, 2020

(54) BIOLOGICAL SAFETY CABINET AND CLEAN BENCH

(71) Applicant: PHC HOLDINGS CORPORATION, Tokyo (JP)

(72) Inventors: Ritaro Oguma, Saitama (JP); Shinji Sugimoto, Gunma (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 240 days.

(21) Appl. No.: 15/982,845

(22) Filed: May 17, 2018

(65) Prior Publication Data

US 2018/0264459 A1 Sep. 20, 2018

Related U.S. Application Data

(63) Continuation of application No. PCT/JP2016/083655, filed on Nov. 14, 2016.

(30) Foreign Application Priority Data

Nov. 18, 2015 (JP) ..... 2015-225346

(51) Int. Cl.
*B01L 1/02* (2006.01)
*B01L 1/00* (2006.01)
(Continued)

(52) U.S. Cl.
CPC *B01L 1/02* (2013.01); *B01L 1/00* (2013.01); *B08B 15/023* (2013.01);
(Continued)

(58) Field of Classification Search
CPC ..... B01L 1/02; B01L 1/00; B01L 2200/08; B01L 2200/141; B01L 2300/10; B01L 2300/14; B08B 15/023; F24F 3/1607
(Continued)

(56) References Cited

U.S. PATENT DOCUMENTS 3,025,780 A * 3/1962 Russell ..... B08B 15/023 454/56
3,874,754 A * 4/1975 Saunders ..... B01L 1/04 312/209
(Continued)

FOREIGN PATENT DOCUMENTS

JP S64-075834 A 3/1989
JP H02-144157 A 6/1990
(Continued)

OTHER PUBLICATIONS

International Preliminary Report on Patentability issued in International Patent Application No. PCT/JP2016/083655, dated Oct. 31, 2017; with English translation.
(Continued)

*Primary Examiner* — Steven B McAllister
*Assistant Examiner* — Dana K Tighe
(74) *Attorney, Agent, or Firm* — McDermott Will & Emery LLP

(57) ABSTRACT

A biological safety cabinet or the like according to an embodiment of the present disclosure includes: a bottom plate 4 provided in a body case 2; and a flexible portion 13 provided to a front shutter protector 6 that is provided to a lower end of the front shutter 5, and is capable of ensure reliability by reducing the load of the front shutter such that outside air is drawn into the body case 2 through a gap 15 formed in a contact portion between the flexible portion 13 and the bottom plate 4.

10 Claims, 4 Drawing Sheets

(51) Int. Cl.
*F24F 3/16* (2006.01)
*B08B 15/02* (2006.01)

(52) U.S. Cl.
CPC ..... *F24F 3/1607* (2013.01); *B01L 2200/08* (2013.01); *B01L 2200/141* (2013.01); *B01L 2300/10* (2013.01); *B01L 2300/14* (2013.01)

(58) Field of Classification Search
USPC ..... 454/56
See application file for complete search history.

(56) References Cited

U.S. PATENT DOCUMENTS 3,895,570 A * 7/1975 Eagleson, Jr. ..... B08B 15/02 454/57
4,249,463 A * 2/1981 Hornby ..... B08B 15/023 454/57
5,380,244 A * 1/1995 Tipton ..... B08B 15/023 454/57
6,036,737 A * 3/2000 Smith ..... B01D 46/42 454/56
7,048,625 B2 * 5/2006 Anezaki ..... B08B 15/023 454/56

FOREIGN PATENT DOCUMENTS

JP 2005-270820 A 10/2005
JP 2008-114179 A 5/2008
JP 2014-193463 A 10/2014
JP 2015-077554 A 4/2015

OTHER PUBLICATIONS

Written Opinion of the International Searching Authority, issued in International Patent Application No. PCT/JP2016/083655, dated Dec. 27, 2016; with English translation.

* cited by examiner

BIOLOGICAL SAFETY CABINET AND CLEAN BENCH

CROSS-REFERENCE TO RELATED APPLICATION

This is a continuation application of International Patent Application No. PCT/JP2016/083655 filed Nov. 14, 2016, which claims the benefit of priority to Japanese Patent Application No. 2015-225346 filed Nov. 18, 2015. The full contents of the International Patent Application are incorporated herein by reference.

TECHNICAL FIELD

The present disclosure relates to a biological safety cabinet and a clean bench used for environmental laboratory equipment, for example.

BACKGROUND ART

In this type of a conventional cabinet, for example, a biological safety cabinet includes a box-like body case; and an air conditioner to perform air conditioning in the interior of this body case. Air flows such that the air in the body case is circulated by the air conditioner, and a part or all of the air is discharged, so that substantially the same amount of air as the discharged air is drawn through a space of a worker's hand insertion portion that is provided between a front shutter provided for a front opening of the body case and a bottom plate.

Japanese Patent Application No. 2014-193463 is a prior document similar to this.

A biological safety cabinet or a clean bench (hereinafter, referred to as the "biological safety cabinet or the like) is required to maintain the interior of a body case under negative pressure or positive pressure using an air conditioner, to ensure cleanliness in the interior of the body case when a worker performs work inside the body case.

Further, in order not to significantly lower the cleanliness inside the body case except during work, it is common practice to fully lower a front shutter when work is interrupted or finished.

In such a case, when all the front opening is covered with the front shutter during the operation of the air conditioner such that the space of the worker's hand insertion portion is eliminated, positive pressure or negative pressure is applied to the front shutter and the front shutter may be damaged.

For this reason, the conventional biological safety cabinet or the like has a configuration in which the bottom plate and the front shutter are not in contact with each other when the front shutter is fully lowered. This may make it impossible to sufficiently maintain cleanliness in the interior of the body case, which may not ensure reliability as a biological safety cabinet or the like.

Thus, an aspect of the present disclosure is to maintain cleanliness in an interior a body case as well as reduce the load of a front shutter even in a state in which a biological safety cabinet or the like is not used, thereby ensuring reliability.

SUMMARY

An aspect of the present disclosure is to include a box-like body case having an opening portion in its front face; an air conditioner configured to perform air conditioning in an interior of the body case; a bottom plate provided inside the opening portion; a front-side gas discharge portion provided in the bottom plate on a front face side in the body case; a front shutter movable in a vertical direction to cover the opening portion; a front shutter protector provided at a lower end of the front shutter; and a flexible portion provided to the front shutter protector, the flexible portion being configured to contact the bottom plate in front of the front-side gas discharge portion, when the front shutter is fully lowered, the flexible portion having a width substantially equal to a width of the opening portion; and a gap portion formed in a contact portion between the flexible portion and the bottom plate.

DETAILED DESCRIPTION

Hereinafter, an embodiment of the present disclosure will be described in detail with reference to accompanying drawings.

Embodiment 1

Figure 1:
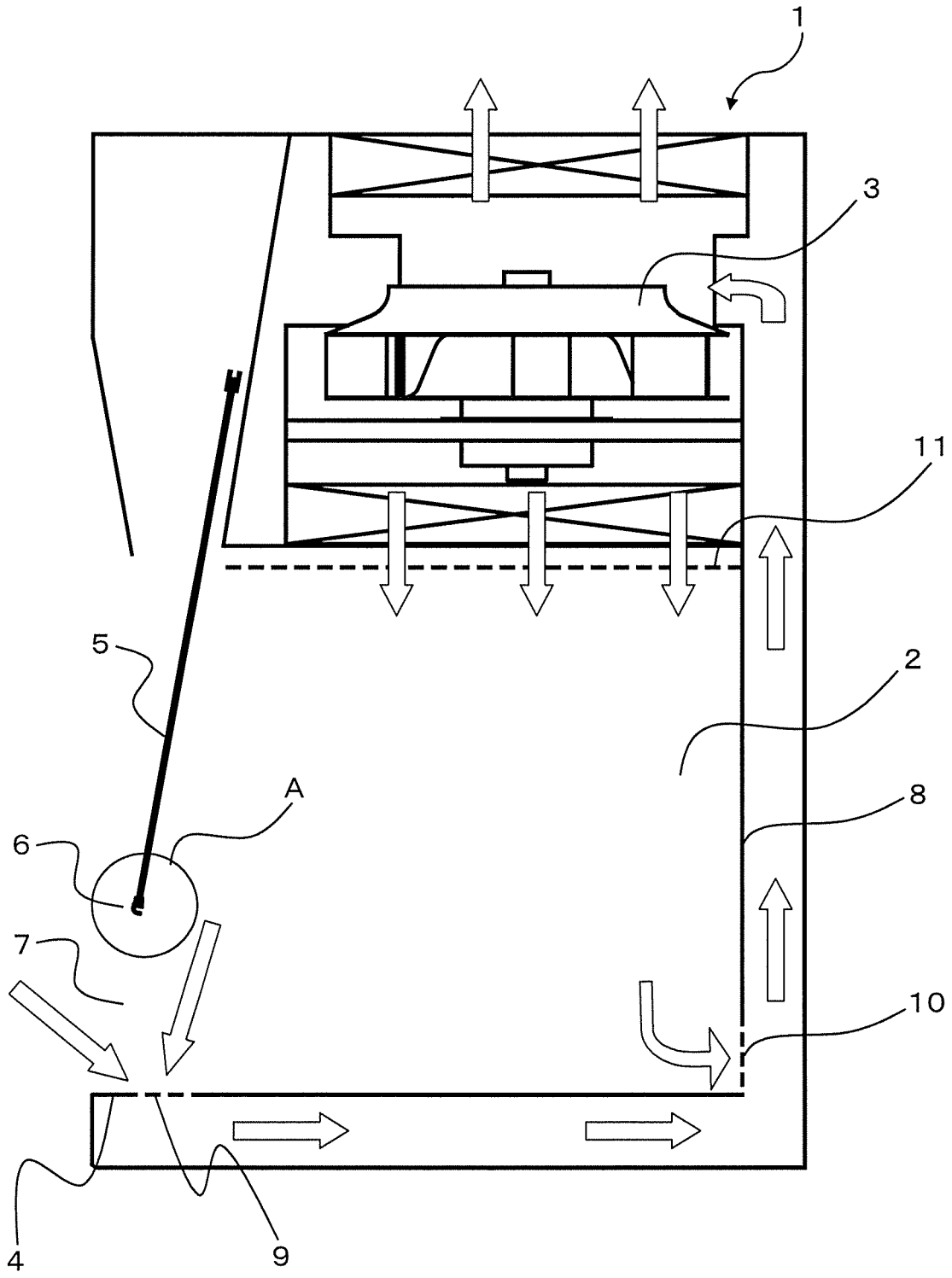
FIG. 1 is a schematic cross-sectional view illustrating a biological safety cabinet according to an embodiment of the present disclosure.

FIG. 1 is a schematic cross-sectional view illustrating a biological safety cabinet according to an embodiment of the present disclosure.

As illustrated in FIG. 1, a biological safety cabinet (hereinafter, referred to as the cabinet) 1 according to an embodiment of the present disclosure is an apparatus used for environmental laboratory equipment, for example, and a worker uses this apparatus to perform work of handling bacteria, viruses, etc.

The cabinet 1 includes a body case 2, an air conditioner 3, a bottom plate 4, a front shutter 5, and a front shutter protector 6.

The body case 2 is a box-like member including an opening portion 7 in a front face. A worker using the cabinet 1 performs work with his/her hand(s) being inserted from the opening portion 7 into the body case 2.

The opening portion 7 of the body case 2 is to be covered with the front shutter 5. The front shutter 5 is configured to be movable in a vertical (up-and-down) direction with respect to the cabinet 1. This front shutter 5 is moved to increase or reduce an opening region of the opening portion 7 in the body case 2.

In specific, for example, when a sample and/or equipment for experiment is placed into the body case 2, the front shutter 5 is moved upward to increase the opening region of the opening portion 7 so as to easily perform work.

Further, in the stage of performing work such as experiment after placing such a sample and/or equipment in the interior of the body case 2, the front shutter 5 is moved downward to reduce the opening region of the opening portion 7 so as to secure work environment necessary for such experiment in the interior of the body case 2.

That is, the opening region of the opening portion 7 is large enough to allow a worker to perform work with his/her hand(s) being inserted into the body case 2 from the opening portion 7 as well as small enough to allow bacteria, viruses, and/or the like handled by a worker to be kept in the interior of the body case 2.

The front shutter 5 is constituted by a transparent member such as a glass plate, and configured such that a worker, in a state of performing work such as an experiment, can perform work while visually checking the state inside the body case 2 through the front shutter 5.

The bottom plate 4 is provided on the bottom face side which is in the lower direction in the body case 2.

The bottom plate 4, which is, for example, a metal plate-like member, is formed by press working or the like, and is provided to be substantially orthogonal to the back plate.

The bottom plate 4 includes a work platform where an experiment or the like is performed.

Then, a back plate 8 is provided on the side opposite to the front shutter 5 in the body case 2. In other words, the back plate 8 is provided on the back face side which is in the rear direction in the body case 2.

The back plate 8 is, for example, a metal plate-like member, and the body case 2 formed by press working or the like further includes a pair of side plates, in the lateral (left-and-right) direction, substantially orthogonal to the back plate, and an upper face plate, in the upper direction, substantially orthogonal to the back plate.

Accordingly, a box-like work space is formed inside the body case 2.

The air conditioner 3 is installed on the top face side, which is the upper direction in the body case 2.

The air conditioner 3 is a device to send air into the interior of the body case 2, and includes a filter such as a High-Efficiency Particulate Air filter (HEPA).

Then, the air obtained by removing unwanted bacteria using this filter is sent into the body case 2, so that the environment inside the body case 2 is kept in an aseptic state.

Further, in the bottom plate 4, a front-side gas discharge portion 9 is provided on the front face side of the body case 2, and a back-side gas discharge portion 10 is provided on the lower side in the back plate 8.

The air sent into the interior of the body case 2 by the air conditioner 3 is discharged from the front-side gas discharge portion 9 and the back-side gas discharge portion 10 to the outside of the body case 2.

A flow arrangement plate 11 is provided below the air conditioner 3.

In specific, for example, the flow arrangement plate 11 is provided by fixing or supporting at three points, i.e., on the opening portion side which is in the front direction, on the back face side which is in the rear direction, and at the central portion which is the center between the opening portion side and the back face side, in the body case 2.

Here, the front shutter protector 6 according to an embodiment of the present disclosure will be described in more detail with reference to FIG. 2.

Figure 2:
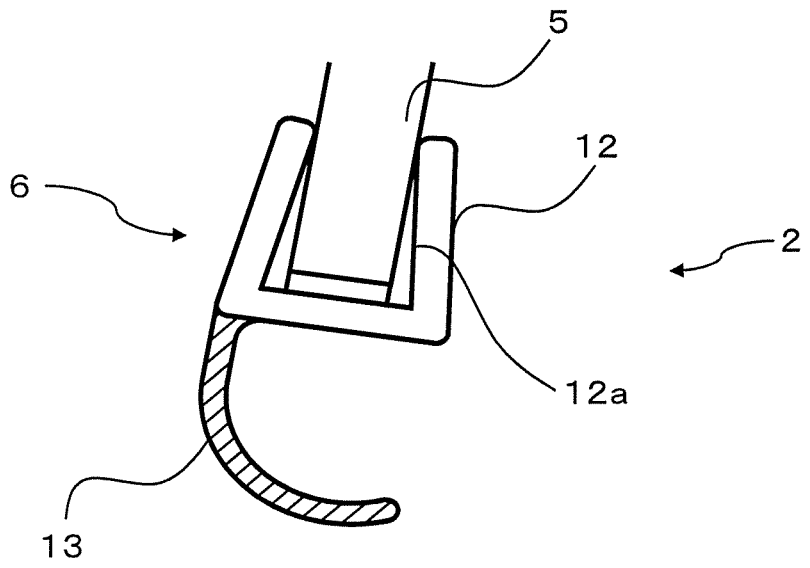
FIG. 2 is a diagram illustrating a main part of a biological safety cabinet in FIG. 1.

FIG. 2 is a detailed cross-sectional view obtained by enlarging a portion A illustrated in FIG. 1.

As illustrated in FIG. 2, the front shutter protector is constituted by a hard portion 12 and a flexible portion 13.

The hard portion 12 includes a mounting portion 12*a* for mounting the front shutter protector 6 to the front shutter 5.

The hard portion 12 is formed, for example, by molding a resin material such as Polyvinyl Chloride (PVC), Polymethyl Methaclylate (PMMA), Acrylonitrile/Ethylene-Propylene-Diene/Styrene (AES), or Acrylate Styrene Acrylonitrile (ASA).

The mounting portion 12*a* has, for example, a clip-like shape having an opening in its upper portion, and the mounting portion 12*a* is inserted from the opened upper portion toward the lower end surface of the front shutter 5. Then, the mounting portion 12*a* is configured, for example, to be press fitted to the lower end surface of the front shutter 5, so that the mounting portion 12*a* is mounted to the lower end surface of the front shutter 5.

Figure 3:
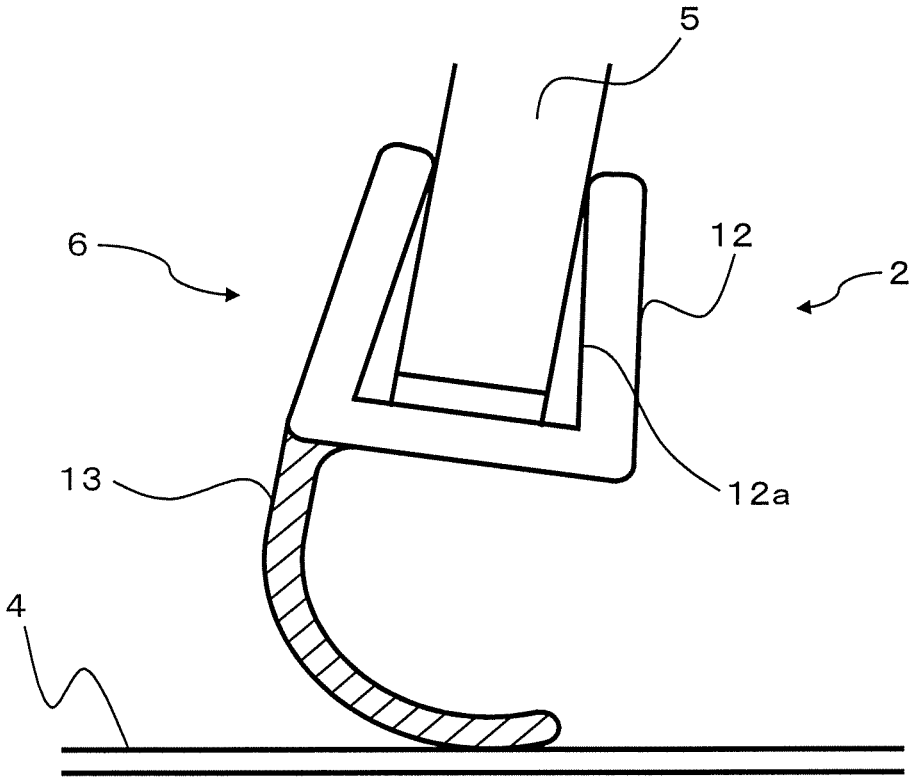
FIG. 3 is a diagram illustrating a main part of a biological safety cabinet in FIG. 1.

FIG. 3 is a detailed cross-sectional view in which the flexible portion 13 is in contact with the bottom plate 4 when the front shutter 5 is fully lowered.

As illustrated in FIG. 3, when the front shutter 5 is fully lowered, the flexible portion 13 is provided to be longer than a space distance between the hard portion 12 and the bottom plate 4, as well as to have a width substantially equal to the width of the opening portion 7 illustrated in FIG. 1, and contacts the bottom plate 4 in front of the front-side gas discharge portion 9.

The flexible portion 13 is made of a material having flexibility such as rubber, soft polyvinyl chloride having a hardness of substantially 60 degrees, or soft polymethyl methacrylate resin, and contacts the bottom plate 4 while being bent when the front shutter 5 is fully lowered. In other words, the flexible portion 13 is configured to be bent to contact the bottom plate 4 in a state of being pressed thereagainst. This can reduce creation of a gap on a surface where the flexible portion 13 contacts the bottom plate 4.

It should be noted that a contact portion indicates a range, having a width substantially equal to the width of the opening portion 7 (see FIG. 1) in the body case 2, in which the flexible portion 13 and the bottom plate 4 are in contact with each other.

Here, it is preferable that a material of the flexible portion 13 has a hardness less than the hardness of the material of the hard portion 12.

Then, it becomes possible to prevent foreign matter from the outside from entering the interior of the body case 2, in a state in which this product is not used by bringing the flexible portion 13 into contact with the bottom plate 4 when the front shutter 5 is fully lowered.

It should be noted that, in an embodiment of the present disclosure, the front shutter protector 6 is described as being constituted by the hard portion 12 and the flexible portion 13, but it is not limited thereto.

For example, a configuration may be such that the flexible portion 13 is formed directly in the front shutter 5 without using the hard portion 12.

In specific, a configuration may be such that a coupling portion and a coupled portion are formed in the front shutter 5 and the flexible portion 13, respectively, such that they are assembled by fitting or the like. Further, a configuration may also be such that, depending on the materials of the front shutter 5 and the flexible portion 13, they are coupled by bonding, welding, or the like.

Next, a gap formed by the bottom plate 4 and the flexible portion 13 will be described in detail with reference to FIGS. 4A to 4C and 5A to 5C.

FIGS. 4A to 4C and 5A to 5C are detailed diagrams illustrating a state, when viewed from the front, in which the flexible portion 13 of the front shutter protector 6 is in contact with the bottom plate 4 when the front shutter 5 is fully lowered.

Figures 4A, 4B, 4C:
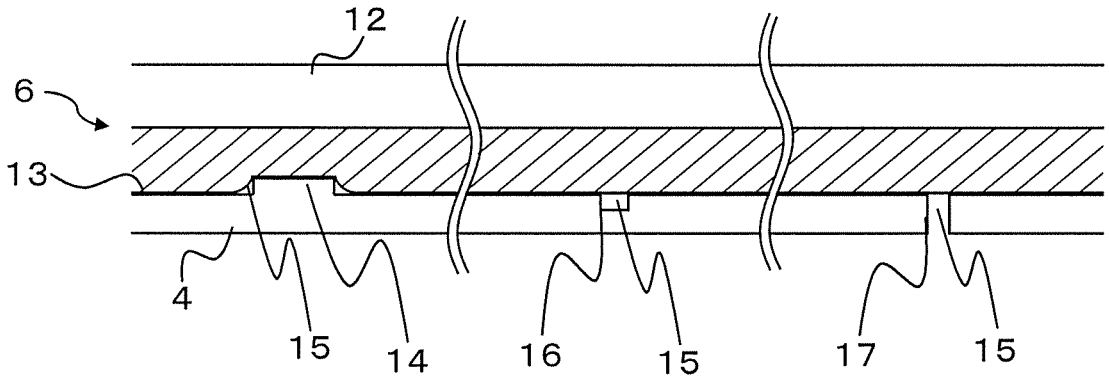
FIGS. 4A to 4C are diagrams each illustrating a main part of a biological safety cabinet in FIG. 1.

As illustrated in FIG. 4A, a projection 14 is provided in the bottom plate 4, and a gap 15 is formed by the bottom plate 4 and the flexible portion 13 in a state in which the front shutter 5 is fully lowered. In other words, the gap 15 is formed by changing the height at which the flexible portion 13 comes in contact, when the front shutter 5 is fully lowered.

This enables a configuration in which the outside air can be drawn into the body case 2 through the gap 15 that is formed by contact between the flexible portion 13 and the projection 14, during the operation of the air conditioner 3. It should be noted that, although omitted in FIG. 4A, the front shutter 5 is disposed above the hard portion 12, as illustrated in FIG. 2.

Further, the gap 15, through which the outside air is drawn into the body case 2, may be formed by providing a recess 16 as illustrated in FIG. 4B, or a hole 17 as illustrated in FIG. 4C, in the bottom plate 4.

Figures 5A, 5B, 5C:
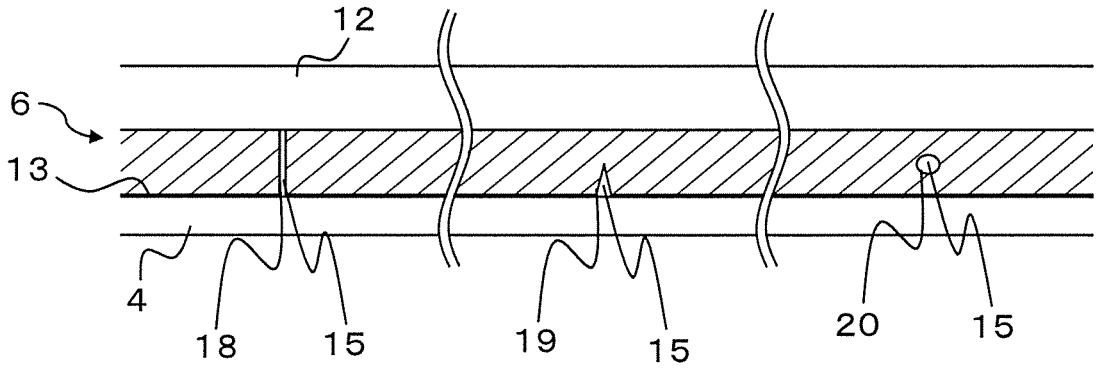
FIGS. 5A to 5C are diagrams each illustrating a main part of a biological safety cabinet in FIG. 1.

Further, as illustrated in FIGS. 5A to 5C, the gap 15 may be formed by providing a slit 18 as illustrated in FIG. 5A, a cut 19 as illustrated in FIG. 5B, or a hole 20 as illustrated in FIG. 5C, in the flexible portion 13.

As has been described above, in an embodiment of the present disclosure, the opening portion 7 is configured such that the outside air is drawn therethrough into the body case 2 or the air inside the body case 2 is blown out therethrough by the air conditioner 3, and it is possible to maintain cleanliness in the interior the body case 2 and reducing the load of the front shutter 5, when the biological safety cabinet 1 or the like is not used.

Further, it is possible to connect the interior of the body case 2 and the exterior thereof with the gap 15, while maintaining a state in which the flexible portion 13 of the front shutter protector 6 and the bottom plate 4 are in contact with each other by fully lowering the front shutter 5, even during the operation of the air conditioner 3. That is, it is possible to draw the outside air into the body case 2 through the gap 15.

Thus, it is possible to maintain cleanliness in the body case 2 and reduce the load of the front shutter 5 when the biological safety cabinet 1 or the like is not used. As a result, it is possible to ensure reliability as a biological safety cabinet 1 or the like.

Next, the placement and shape of the projection 14 provided in the bottom plate 4 will be described in detail, with reference to FIGS. 6A, 6B, and 7.

Figures 6A, 6B:
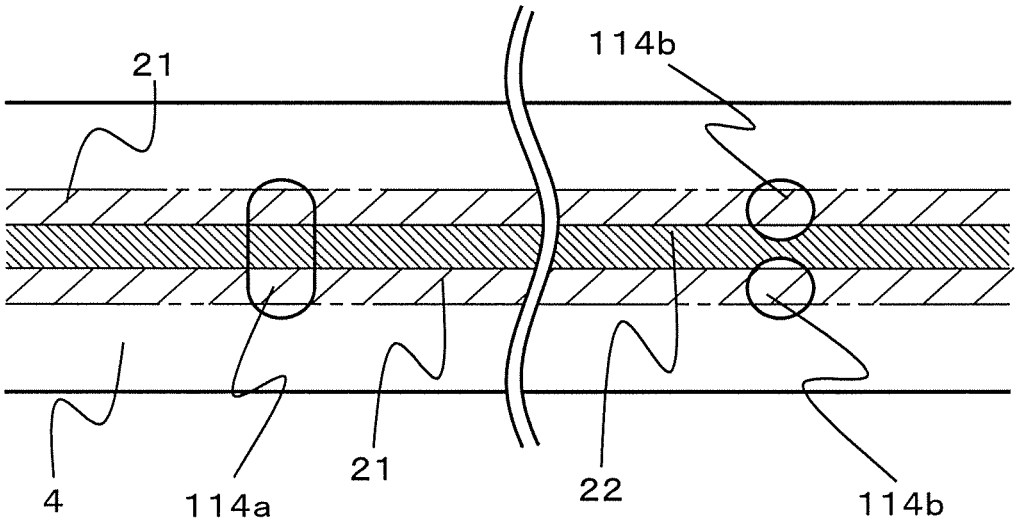
FIGS. 6A and 6B are diagrams each illustrating a main part of a biological safety cabinet in FIG. 1.
Figure 7:
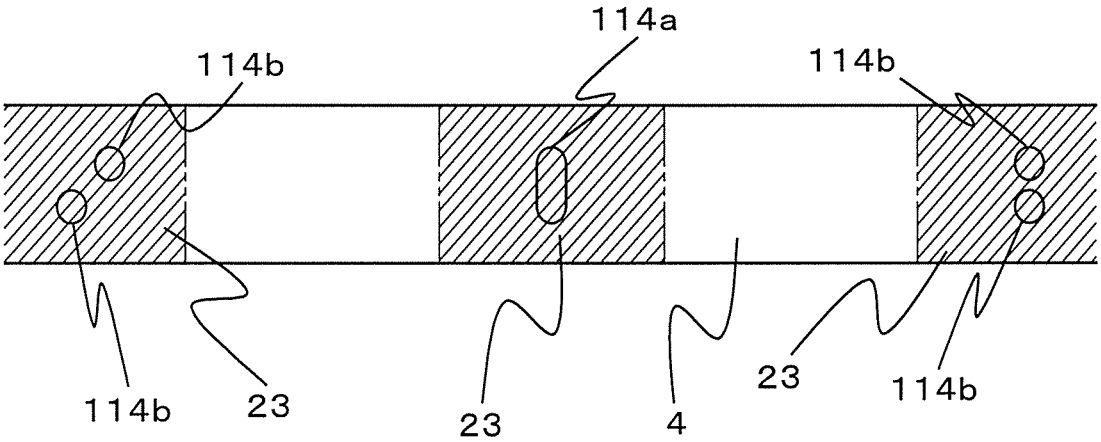
FIG. 7 is a diagram illustrating a main part of a biological safety cabinet in FIG. 1.

FIGS. 6A, 6B, and 7 are diagrams illustrating the bottom plate 4 when viewed from above, and illustrating examples of the placement and shapes of the projection(s) 14 provided in the bottom plate 4. In FIGS. 6A, 6B, and 7, also, the front shutter 5 is omitted as in FIGS. 4A to 4C and 5A to 5C.

It is assumed that the positional relationship between the bottom plate 4 and the front shutter 5 slightly varies due to variations in assembly and the like. A sparsely shaded area in FIGS. 6A and 6B illustrates a virtual range in which the flexible portion 13 of the front shutter protector 6 is to contact the bottom plate 4 considering such variations.

In contrast to the virtual range 21, a densely shaded area in FIGS. 6A and 6B illustrates an actual range 22 in which the flexible portion 13 of the front shutter protector 6 actually contacts the bottom plate 4.

FIG. 6A illustrates an example in which a projection 114*a* is formed to be greater than the virtual range 21 where the flexible portion 13 of the front shutter protector 6 is to be in contact. Accordingly, with the use of the projection 114*a* larger than the virtual range 21, it becomes possible to reliably form the gap 15 that is formed by the bottom plate 4 and the flexible portion 13 when the front shutter 5 is fully lowered.

Here, the projection 114*a* having a substantially elliptical shape is illustrated as an example, but the shape is not limited thereto, and its external shape is not restricted but may be, for example, a rectangular shape, a circular shape, an irregular shape, or the like.

Further, in the case in which the projection 114*a* greater than the virtual range 21 is too large and its existence becomes an obstacle, a plurality of projections 114*b* smaller than the virtual range 21 may be provided to be distributed more broadly than in the virtual range 21, as illustrated in FIG. 63. This can also enable reliable formation of the gap 15, which is formed by the bottom plate 4 and the flexible portion 13, when the front shutter 5 is fully lowered.

Here, two small circular projections 114*b* are arranged, but the shape and number are not limited thereto. Further, the projection(s) 114*a* and the projection(s) 114*b* may be provided in a mixed manner in the bottom plate 4.

Further, the bottom plate 4 is a part on which a worker using the cabinet 1 may place his/her arm(s) to perform work. Thus, as illustrated in FIG. 7, when a plurality of projections including the projection 114*a* and the projection 114*b* are disposed in the lateral direction, such projections are placed in at least one of ranges 23 depicted by shaded areas in which a worker's arm(s) does not touch.

This enables the projections 14, 114*a*, 114*b* to be placed so as to avoid the worker's arm(s), thereby being able to remove annoyance caused by the worker's arm(s) touching the projections 14, 114*a*, 114*b*. The description is given with the five projections 114*a*, 114*b* illustrated at three positions in FIG. 7, but the shape and number are not limited thereto.

In the examples of the placement and shape of the projections 114*a*, 114*b* illustrated in FIGS. 6A, 6B, and 7, recesses or holes may be used in place of projections 114*a*, 114*b*, and similar effects can be achieved.

Further, in an embodiment of the present disclosure, the biological safety cabinet 1 has been described as an example, but it is not limited thereto, and a clean bench or the like may be used. That is, the clean bench is configured such that the air in the body case 2 is blown out through the opening portion 7 of the cabinet 1 illustrated in FIG. 1, but such a clean bench can achieve similar effects by implementing the present disclosure.

That is, when the front shutter is fully lowered, the air in a body case is blown out through a gap portion formed in a contact portion between the bottom plate and the flexible portion, thereby being able to maintain cleanliness in the interior a body case and reduce the load of a front shutter when the clean bench or the like is not used, which can ensure reliability.

As has been described above, in the biological safety cabinet and the clean bench according to an embodiment of the present disclosure, reliability can be ensured as a biological safety cabinet and a clean bench.

Accordingly, for example, the utilization as the biological safety cabinet and the clean bench used for environmental laboratory equipment is greatly expected.

As has been described above, embodiments of the present disclosure can ensure reliability as a biological safety cabinet or the like. That is, an opening portion is configured such that outside air is drawn therethrough into a body case or the air in the body case is blown out therethrough by an air conditioner, and it is possible to maintain cleanliness in the interior the body case and reduce the load of a front shutter when a biological safety cabinet or the like is not used.

Further, it is possible to maintain a state in which a flexible portion of a front shutter protector and a bottom plate are in contact with each other by fully lowering a front shutter, as well as to connect the interior of a body case and the exterior thereof with a gap portion, even during an operation of an air conditioner.

Accordingly, it is possible to maintain cleanliness in the interior a body case and reduce the load of a front shutter even when a biological safety cabinet or the like is not used. As a result, it is possible to ensure reliability as a biological safety cabinet or the like.

It should be noted that embodiments described above are intended for easy understanding of the present disclosure and are not in any way to be construed as limiting the present disclosure. The present disclosure may be modified and improved without departing from the scope of the disclosure, and equivalents thereof are also encompassed by the disclosure.

What is claimed is:

1. A biological safety cabinet comprising:

a body case having an opening portion in its front face;

an air conditioner configured to perform air conditioning in an interior of the body case;

a bottom plate provided inside the opening portion;

a front-side gas discharge portion provided in the bottom plate on a front face side in the body case;

a front shutter movable in a vertical direction to cover the opening portion;

a front shutter protector provided at a lower end of the front shutter;

a flexible portion provided to the front shutter protector, the flexible portion being configured to contact the bottom plate in front of the front-side gas discharge portion, when the front shutter is fully lowered, the flexible portion having a width substantially equal to a width of the opening portion; and a gap formed by the flexible portion and the bottom plate such that air flows between the interior of the body case and outside of the body case through the gap, when the front shutter is fully lowered.

2. The biological safety cabinet according to claim 1, wherein the gap is formed by providing a projection, a recess, or a hole in the bottom plate in the contact portion between the bottom plate and the flexible portion.

3. The biological safety cabinet according to claim 2, wherein:

the flexible portion contacts the bottom plate at a region having a width in a front-to-back direction, and a size of the projection, the recess, or the hole in the front-to-back direction is greater than the width of the region.

4. The biological safety cabinet according to claim 2, wherein:

the flexible portion contacts the bottom plate at a region having a certain width in a front-to-back direction, a size of the projection, the recess or the hole in the front-to-back direction is smaller than the width of the region, the projection, the recess or the hole includes a plurality of projections, recesses or holes, respectively, and the plurality of projections, recesses or holes are provided to be distributed more broadly than in the range in which the flexible portion contacts the bottom plate.

5. The biological safety cabinet according to claim 1, wherein the gap is formed by providing a slit, a cut, or a hole in the flexible portion.

6. A clean bench comprising:

a body case having an opening portion in its front face;

an air conditioner configured to perform air conditioning in an interior of the body case;

a bottom plate provided inside the opening portion;

a front-side gas discharge portion provided in the bottom plate on a front face side in the body case;

a front shutter movable in a vertical direction to cover the opening portion;

a front shutter protector provided at a lower end of the front shutter;

a hard portion including a front shutter mounting portion, the hard portion being provided to the front shutter protector;

a flexible portion provided to be longer than a space distance between the hard portion and the bottom plate and to have a width substantially equal to a width of the opening portion, and configured to contact the bottom plate in front of the front-side gas discharge portion, when the front shutter is fully lowered; and a gap formed by the flexible portion and the bottom plate such that air flows between the interior of the body case and outside of the body case through the gap, when the front shutter is fully lowered.

7. The clean bench according to claim 6, wherein the gap is formed by providing a projection, a recess, or a hole in the bottom plate in the contact portion between the bottom plate and the flexible portion.

8. The clean bench according to claim 7, wherein the flexible portion contacts the bottom plate at a region having a certain width in a front-to-back direction, and a size of the projection, the recess or the hole in the front-to-back direction is greater than the width of the region.

9. The clean bench according to claim 7, wherein:

the flexible portion contacts the bottom plate at a region having a certain width in a front-to-back direction, a size of the projection, the recess or the hole in the front-to-back direction is smaller than the width of the region, the projection, the recess or the hole includes a plurality of projections, recesses or holes, respectively, and the plurality of projections, recesses or holes are provided to be distributed more broadly than in the range in which the flexible portion contacts the bottom plate.

10. The clean bench according to claim 6, wherein the gap is formed by providing a slit, a cut, or a hole in the flexible portion.

* * * * *